US006637592B1

(12) United States Patent
Lai

(10) Patent No.: US 6,637,592 B1
(45) Date of Patent: Oct. 28, 2003

(54) TOOL CASE

(75) Inventor: Mei-Hsiang Lai, Tai-Chung (TW)

(73) Assignee: Eagle Tool Co., Ltd., Tai-Chung (TW)

( * ) Notice: Subject to any disclaimer, the term of this patent is extended or adjusted under 35 U.S.C. 154(b) by 0 days.

(21) Appl. No.: 10/134,966

(22) Filed: Apr. 30, 2002

(51) Int. Cl.[7] ..... B65D 85/28
(52) U.S. Cl. ..... 206/372; 220/7; 312/902
(58) Field of Search ..... 206/349, 372, 206/373; 220/4.28, 4.33, 6, 7, 617, 691; 312/107, 111, 902; 211/70.6

(56) References Cited

U.S. PATENT DOCUMENTS 4,662,515 A * 5/1987 Newby, Sr. ..... 206/349
5,244,265 A * 9/1993 Chiang ..... 312/107
6,193,062 B1 * 2/2001 Rysgaard et al. ..... 206/315.11
6,264,030 B1 * 7/2001 Tsou ..... 206/372
6,578,937 B1 * 6/2003 Thoman ..... 312/107

* cited by examiner

*Primary Examiner*—David T. Fidei
(74) *Attorney, Agent, or Firm*—Charles E. Baxley

(57) ABSTRACT

A combination tool case is constructed to include a front frame unit, a back frame unit, a front frame and back frame fastening structure, a storage box supported on the front frame unit and the back frame unit at a top side, a plurality of drawers mountable in space surrounded by the front frame unit, the back frame unit, and the storage box, and a drawer positioning structure adapted for locking the drawers.

20 Claims, 9 Drawing Sheets

TOOL CASE

BACKGROUND OF THE INVENTION

1. Field of the Invention

The present invention relates to tool cases and, more particularly, to a combination tool case made by coupling plastic tool case parts to one another.

2. Description of the Related Art

Conventional plastic tool cases are commonly comprised of a case body and a cover hinged to the case body by hinge means. The case body has compartments for holding tools and accessories. These plastic tool cases are compact, however, they provide less storage space for holding tools and accessories. Some people may use wooden or metal cases for holding tools. However, wooden or metal cases that are not specifically designed for holding tools cannot keep storage items in good order. When assorted tools and accessories are disorderly put together in a case, they may be damaged easily during transportation of the case. When moved to the work place, it is difficult to pick up the desired tool or accessory from a mass of storage items.

SUMMARY OF THE INVENTION

The present invention has been accomplished under the circumstances in view. It is the main object of the present invention to provide a combination tool case, which is formed by coupling a number of plastic case parts to one another. It is another object of the present invention to provide a combination tool case, which can easily and quickly be set up. It is still another object of the present invention to provide a combination tool case, which provides storage spaces for keeping assorted tools and accessories in good order. To achieve these and other objects of the present invention, the combination tool case comprises a front frame unit, the front frame unit comprising a rectangular open frame and two side panels injection-molded from plastics in integrity, the open frame having two beveled coupling faces disposed at two opposite lateral sides thereof, the side panels each having a beveled coupling face disposed at one side thereof and fitting the beveled coupling faces of the open frame, the beveled coupling faces of the side panels being respectively hinged to the beveled coupling faces of the open frame for enabling the open frame and the side panels to be turned between a first position where the open frame and the side panels are maintained at the same plane, and a second position where the side panels are disposed perpendicular to the open frame and the beveled coupling faces of the side panels are respectively abutted against the beveled coupling faces of the open frame; a back frame unit, the back frame unit comprising a back panel and a bottom panel injection-molded from plastics in integrity, the back panel comprising a beveled coupling face disposed at one side, the bottom panel comprising a beveled coupling face, the back panel comprising a beveled coupling face hinged to the beveled coupling face of the bottom panel for enabling the back panel and the bottom panel to be turned relative to each other between a first position where the back panel and the bottom panel are disposed at the same plane, and a second position where the back panel and the bottom panel are disposed at right angles and the beveled coupling face of the back panel is abutted against the beveled coupling face of the bottom panel; a front frame and back frame fastening structure that secures the front frame unit and the back frame unit together; a storage box supported on the front frame unit and the back frame unit at a top side, the storage box comprised of a box body and a cover pivoted to the box body and adapted for closing/opening the box body; a plurality of drawers mountable in space surrounded by the front frame unit, the back frame unit, and the storage box; and a drawer positioning structure adapted for securing the drawers to the space surrounded by the front frame unit, the back frame unit, and the storage box; the drawer positioning structure comprising a plurality of clamping plates respectively provided at a rear side of each of the drawers, and a locating rod inserted through the clamping plates and rotated through an angle between a first position where the clamping plates are engaged with the locating rod to hold the drawers inside the space surrounded by the front frame unit, the back frame unit, and the storage box, and a second position where the clamping plates are disengaged from the locating rod, enabling the drawers to be moved away from the space surrounded by the front frame unit, the back frame unit, and the storage box.

DETAILED DESCRIPTION OF THE PREFERRED EMBODIMENT

Figure 4:
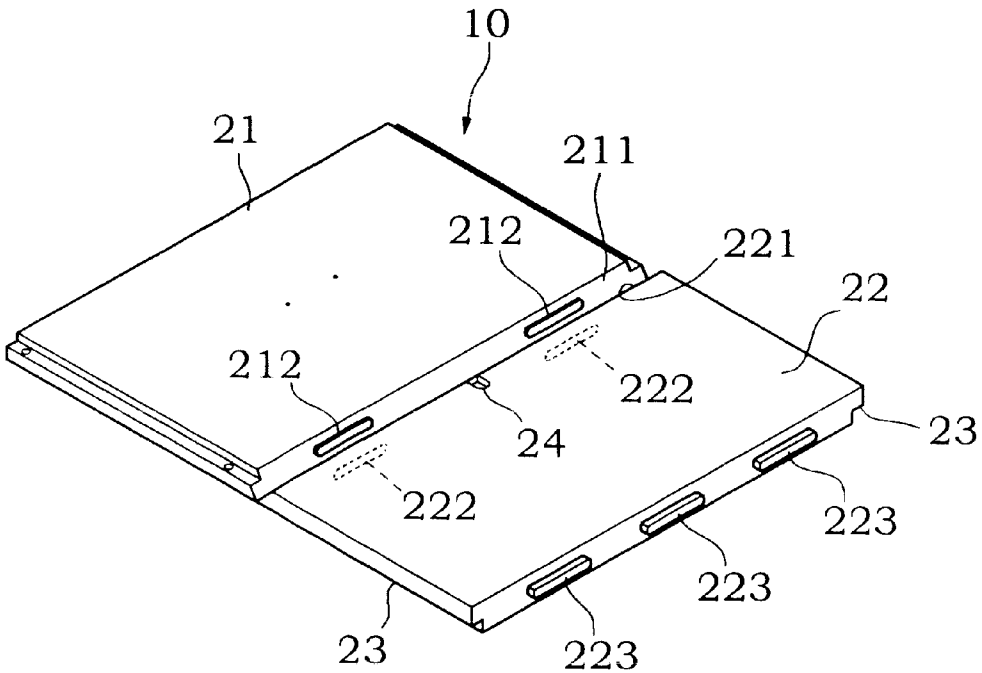
FIG. 4 is an extended view of a back frame unit for the combination tool case according to the present invention.
Figure 5:
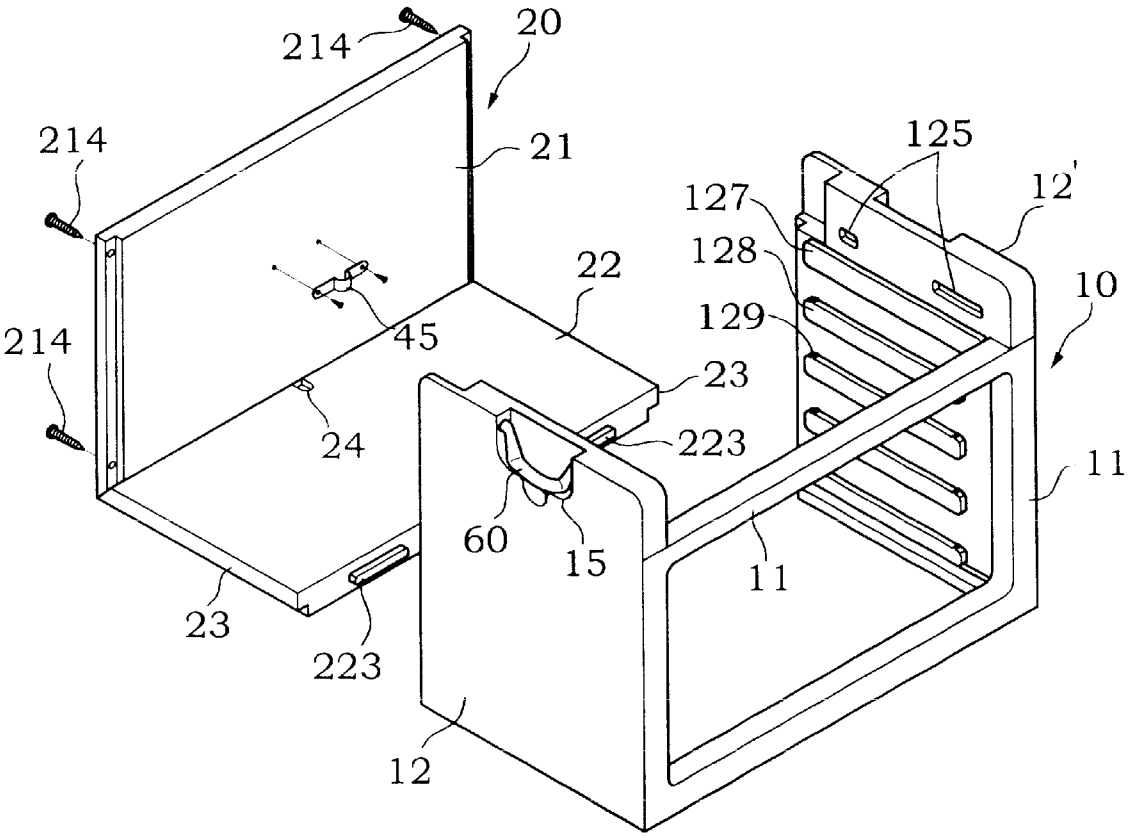
FIG. 5 is an exploded view of a part of the present invention showing the relationship between the front frame unit and the back frame unit.
Figure 6:
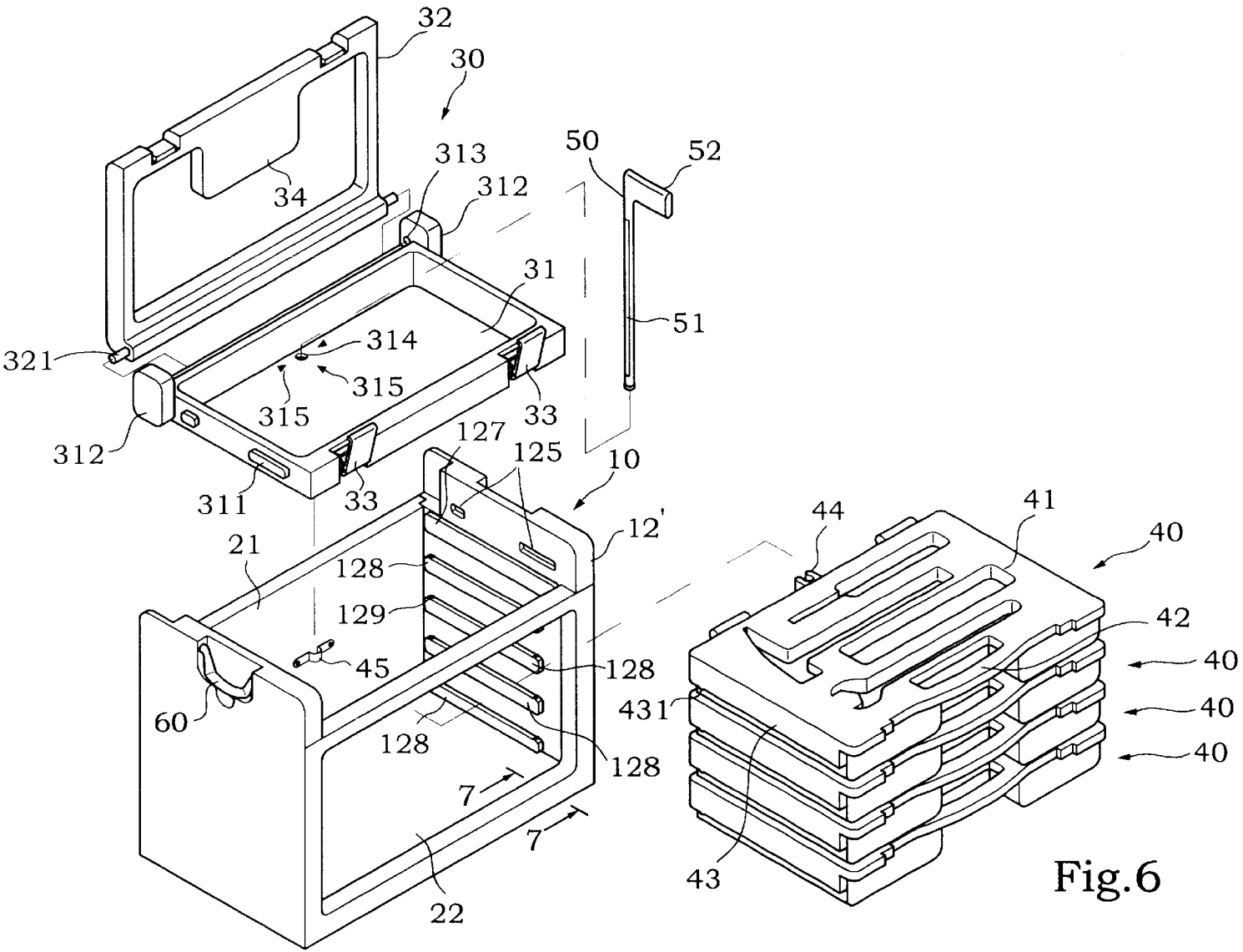
FIG. 6 is an exploded view of the combination tool case according to the present invention.

A combination tool case in accordance with the present invention comprises a front frame unit 10 (see FIGS. 1 and 2), a back frame unit 20 (see FIGS. 4 and 5), a front frame and back frame fastening structure adapted for securing the front frame unit 10 and the back frame unit 20 firmly together, a storage box 30 (see FIGS. 6 and 8), a plurality of drawers 40 (see FIGS. 6 and 8), drawer spacer means (see FIGS. 1, 6, and 10), a drawer partition structure (see FIGS. 1, 6, and 10), a drawer positioning structure (see FIGS. 6, 11A, 11B, and 11C), and two handles 60 (see FIGS. 5 and 6).

Figure 1:
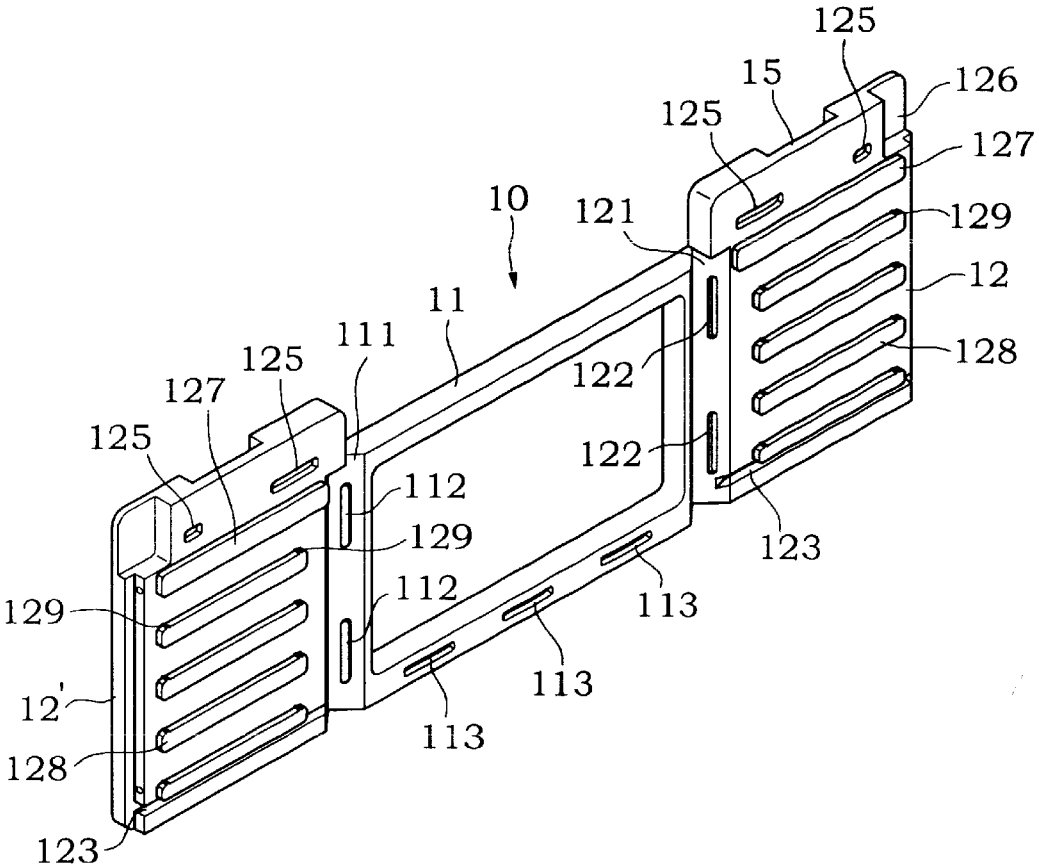
FIG. 1 is an extended view of a front frame unit for the combination tool case according to the present invention.
Figure 2:
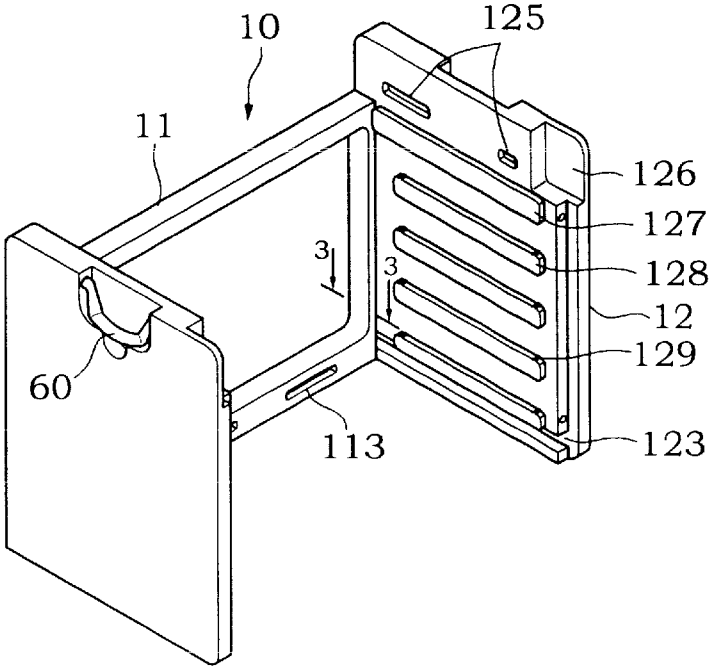
FIG. 2 is an elevational view of the front frame unit when set into the operative position according to the present invention.
Figure 3:
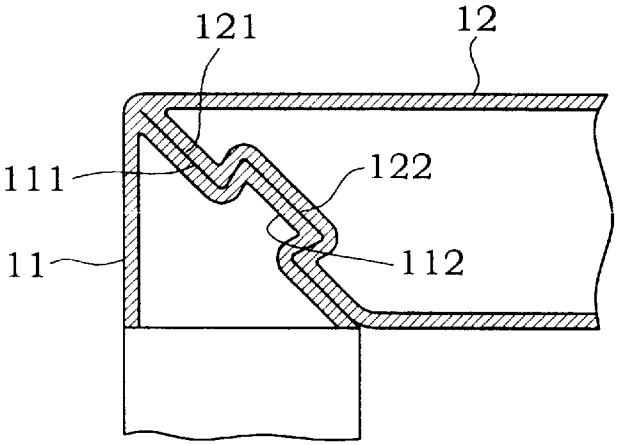
FIG. 3 is a sectional view taken along line 3—3 of FIG. 2.
Figure 7:
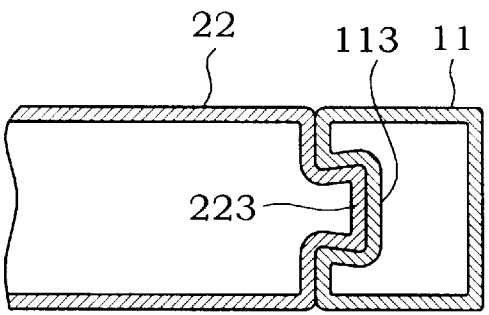
FIG. 7 is a sectional view taken along line 7—7 of FIG. 5.

Referring to FIGS. 1 and 2, the front frame unit 10 comprises a rectangular open frame 11 and two side panels 12;12'. The side panels 12;12' have same structure and shape. The open frame 11 and the side panels 12;12' are molded from plastics. The open frame 11 has two beveled coupling faces 111 disposed at two sides, and a plurality of plug rods 112 respectively protruded from the beveled coupling faces 111. The side panels 12;12' each have a beveled coupling face 121 disposed at one side fitting the beveled coupling faces 111 of the open frame 11, and a plurality of plug holes 122 respectively disposed in the beveled coupling face 121. By press-fitting the plug rods 112 of the open frame 11 into the plug holes 122 of the side panels 12;12', the side panels 12;12' are secured to the open frame 11 at two sides at right angles, keeping the beveled coupling faces 121 of the side panels 12;12' respectively abutted against the beveled coupling faces 111 of the open frame 11. Preferably, the side panels 12;12' are formed integral with the open frame 11, and can be turned relative to the open frame 11 between the position shown in FIG. 1 where the open frame 11 and the side panels 12;12' are maintained at the same plane, and the position shown in FIG. 2 where the side panels 12;12' are disposed perpendicular to the open frame 11.

Referring to FIGS. 4 and 5, the back frame unit 20 comprises a back panel 21 and a bottom panel 22. The back panel 21 and the bottom panel 22 are molded from plastics in unity. The back panel 21 comprises a beveled coupling face 211 disposed at one side, and a plurality of plug rods 212 protruded from the beveled coupling face 211. The bottom panel 22 is hinged to the back panel 21, comprising a beveled coupling face 221 disposed at one side adjacent to the back panel 21 and fitting the beveled coupling face 211 of the back panel 21, and a plurality of plug holes 222 disposed in the beveled coupling face 221 and adapted for accommodating the plug rods 212. When the back panel 21 and the bottom panel 22 turned toward each other, the coupling rods 212 are respectively engaged into the coupling holes 222 and the beveled coupling faces 211;221 are abutted against each other, keeping the back panel 21 and the bottom panel 22 in the angled position.

Referring to FIGS. 2 and 5, the aforesaid front frame and back frame fastening structure comprises a plurality of plug holes 113 disposed in the inner sidewall of the open frame 11 at a bottom side, two sliding grooves 123 respectively transversely disposed in the inner sidewalls of the side panels 12;12', two sliding rails 23 respectively formed integral with two opposite lateral sides of the bottom panel 22, and a plurality of plug rods 223 respectively protruded from the front side edge of the bottom panel 22. The back frame unit 20 is fastened to the front frame unit 10 by: inserting the sliding rails 23 with the bottom panel 2 into the sliding grooves 123 at the side panels 12;12' to engage the plug rods 223 at the bottom panel 22 into the plug holes 113 in the open frame 11. After installation of the back frame unit 20 in the front frame unit 10, screws 214 are respectively driven into the back panel 20 to fixedly secure the back panel 20 to the rear sides of the side panels 12;12'.

Figure 8:
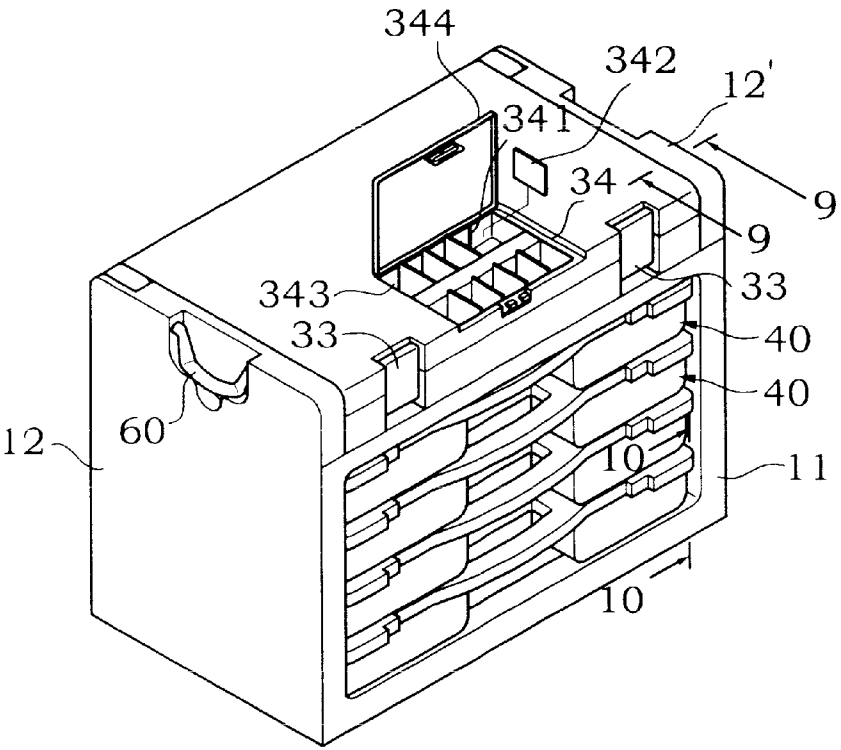
FIG. 8 is an elevational view of the combination tool case according to the present invention.
Figure 9:
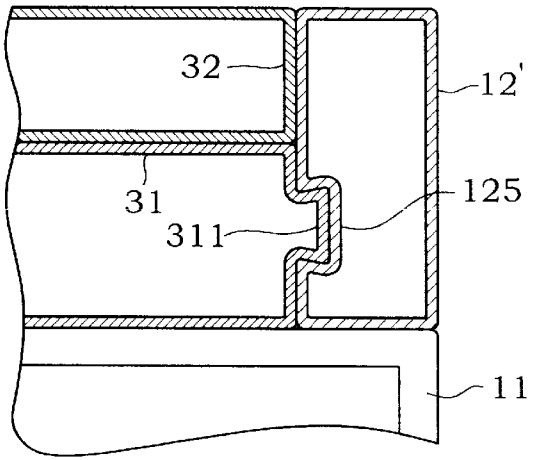
FIG. 9 is a sectional view taken along line 9—9 of FIG. 7.

Referring to FIGS. 6, 8, and 9, the storage box 30 is molded from plastics and mountable to the front frame unit 10 and the back frame unit 20 at the top side, comprised of a box body 31 and a cover 32. The box body 31 is supported on the topside of the open frame 11 of the front frame unit 10, the topside of the back panel 21 of the back frame unit 20, and transverse ribs 127 of the side panels 12;12' of the front frame unit 10 (see also FIG. 1). A positioning structure is provided for securing the box body 31 to the side panels 12;12'. As illustrates in FIG. 9, the positioning structure comprises a plurality of recessed plug holes 125 respectively disposed in the side panels 12;12', and a plurality of engaging blocks 311 respectively protruded from two opposite lateral sidewalls of the box body 31 and adapted for engaging the recessed plug holes 125. The box body 31 further comprises two locating blocks 312 respectively protruded from two ends of the rear side thereof. The side panels 12;12' each have a locating notch 126 adapted for receiving the locating blocks 312 of the box body 31. The locating blocks 312 each have a pivot hole 313 respectively disposed at an inner side. The cover 32 comprises two pivots 321 respectively pivoted to the pivot holes 313 in the locating blocks 312, for enabling the cover 32 to be turned relative to the box body 31 to close/open the box body 31. Snaps 33 are provided at the front side of the box body 31 and the front side of the cover 32 for locking the box body 31 and the cover 32 when the cover 32 closed on the box body 31. The cover 32 comprises a chamber 34, a plurality of partition plates 342 mounted in the chamber 34 and dividing the chamber 34 into compartments 343 for keeping accessories, and a transparent plastic cover plate 344 hinged thereto and adapted for closing the chamber 34.

Referring to FIGS. 6 and 8, the drawers 40 are flat box members respectively molded from plastics and inserted through the open frame 11 into the inside space of the front frame unit 10 between the side panels 12;12', each having a plurality of top recesses 41 adapted for keeping tools, and a front handheld portion 42 for push and pull with the hand.

Figure 10:
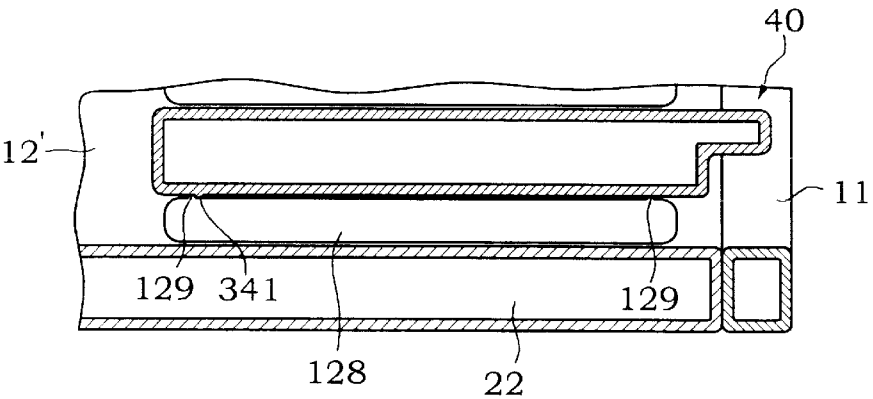
FIG. 10 is a sectional view taken along line 10—10 of FIG. 7.
Figure 11C:
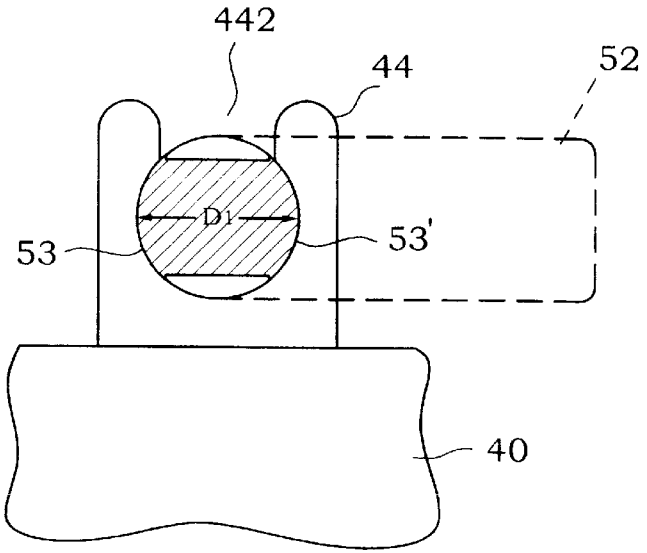
FIG. 11C is a schematic drawing showing the locating rod inserted through the clamping plate and rotated to the locking position.
Figure 11B:
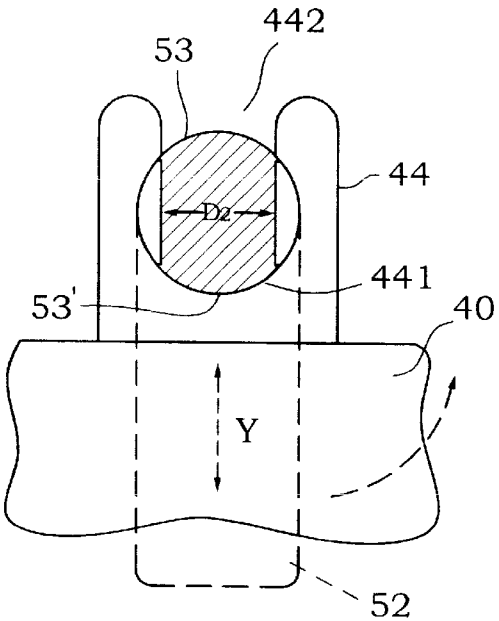
FIG. 11B is a schematic drawing showing the locating rod inserted through the clamping plate and disposed in the unlocking position.
Figure 11A:
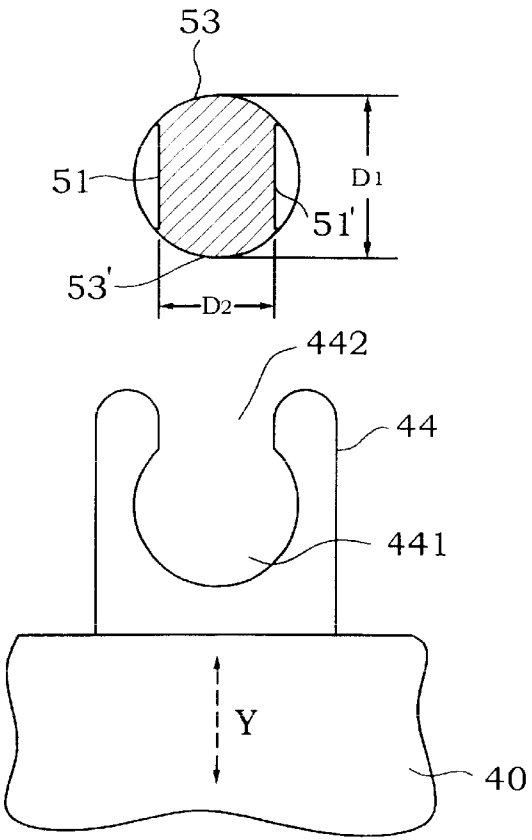
FIG. 11A is a schematic drawing showing the structure of the clamping plate and the locating rod before insertion of the locating rod into the clamping plate.

Referring to FIGS. 1, 6, and 10, the drawer partition structure comprises a plurality of rails 128 symmetrically transversely provided at the side panels 12;12', and a plurality of sliding flanges 43 respectively transversely formed integral with the drawers 40 at two opposite lateral sides and respectively supported on the rails 128. The sliding flanges 43 each have a stop block 431 at the rear end. The rails 128 each have two stop blocks 129 at two ends. The stop blocks 431 are moved with the respective sliding flanges 43 between the stop blocks 129 at the ends of the rails 128 to limit the moving distance of the drawers 40, and to stop the drawers 40 from falling out of the front frame unit 10.

Referring to FIGS. 6, 11A, 11B, and 11C, the drawer positioning structure comprises a locating rod 50, a plurality of clamping plates 44 respectively provided at the rear side of the drawers 40, a through hole 314 through the bottom sidewall of the box body 31, a recessed locating hole 24 in the bottom panel 22 of the back frame unit 20 corresponding to the through hole 314, and a staple 45 fixedly fastened to the inner sidewall of the back panel 21 of the back frame unit 20. Each clamping plate 44 has a circular hole 441 and a mouth 442 in communication with the circular hole 441. The mouth 442 is smaller than the diameter of the circular hole 441. The locating rod 50 has a top end terminating in an angled grip 52, two longitudinal planes 51;51' disposed at two sides, and two smoothly arched faces 53;53' extended in longitudinal direction and bilaterally connected between the longitudinal planes 51;51'. The rod body of the locating rod 50 has two diameters D1;D extended across each other. The major diameter D1 is the line connected between the highest points of the smoothly arched faces 53;53'. The minor diameter D2 is the line connected between the longitudinal planes 51;51'. The major diameter D1 is approximately equal to the diameter of the circular hole 441. The minor diameter D2 is slightly smaller than the pitch of the mouth 442. The locating rod 50 is inserted through the through hole 314, the circular hole 441 of each clamping plate 44, and the staple 45, and then positioned in the recessed locating hole 24 in the bottom panel 22 of the back frame unit 20. When installed, the locating rod 50 can be rotated in the circular holes 441 of the clamping plates 44 between the locking position where the major diameter D1 is disposed perpendicular to the sliding direction Y of the drawers 40 and the drawers 40 are prohibited from movement relative to the locating rod 50 (seed FIG. 11C), and the unlocking position where the minor diameter D2 is disposed perpendicular to the sliding direction Y of the drawers 40 and the drawers 40 are allowed to be disengaged from the locating rod 50 (seed FIG. 11B). Further, marks 315 are made on the box body 31 around the through hole 314 to indicate the direction of rotation of the locating rod 50 between the locking position and the unlocking position.

Referring to FIGS. 5 and 8, the two handles 60 are respectively pivoted to a respective top recess 15 in the outer sidewall of each of the side panels 12;12'. Through the handles 60, the user can carry the combination tool case with the hands conveniently.

As indicated above, the present invention provides a combination tool case, which comprises a front frame unit 10 and a back frame unit 20 coupled together, a storage box 30 supported on the front frame unit 10 and the back frame unit 20 at the top, and a set of drawers 40 mounted in the holding space defined by the front frame unit 10 and the back frame unit 20.

While only one embodiment of the present invention has been shown and described, it will be understood that various modifications and changes could be made thereunto without departing from the spirit and scope of the invention disclosed.

What the invention claimed is:

1. A combination tool case comprising:

a front frame unit, said front frame unit comprising a rectangular open frame and two side panels injection-molded from plastics in integrity, said open frame having two beveled coupling faces disposed at two opposite lateral sides thereof, said side panels each having a beveled coupling face disposed at one side thereof and fitting the beveled coupling faces of said open frame, the beveled coupling faces of said side panels being respectively hinged to the beveled coupling faces of said open frame for enabling said open frame and said side panels to be turned between a first position where said open frame and said side panels are maintained at the same plane, and a second position where said side panels are disposed perpendicular to said open frame and the beveled coupling faces of said side panels are respectively abutted against the beveled coupling faces of said open frame;

a back frame unit, said back frame unit comprising a back panel and a bottom panel injection-molded from plastics in integrity, said back panel comprising a beveled coupling face disposed at one side, said bottom panel comprising a beveled coupling face, said back panel comprising a beveled coupling face hinged to the beveled coupling face of said bottom panel for enabling said back panel and said bottom panel to be turned relative to each other between a first position where said back panel and said bottom panel are disposed at the same plane, and a second position where said back panel and said bottom panel are disposed at right angles and the beveled coupling face of said back panel is abutted against the beveled coupling face of said bottom panel;

a front frame and back frame fastening structure that secures said front frame unit and said back frame unit together;

a storage box supported on said front frame unit and said back frame unit at a top side, said storage box comprised of a box body and a cover pivoted to said box body and adapted for closing/opening said box body;

a plurality of drawers mountable in space surrounded by said front frame unit, said back frame unit, and said storage box; and a drawer positioning structure adapted for securing said drawers to the space surrounded by said front frame unit, said back frame unit, and said storage box; said drawer positioning structure comprising a plurality of clamping plates respectively provided at a rear side of each of said drawers, and a locating rod inserted through said clamping plates and rotated through an angle between a first position where said clamping plates are engaged with said locating rod to hold said drawers inside the space surrounded by said front frame unit, said back frame unit, and said storage box, and a second position where said clamping plates are disengaged from said locating rod, enabling said drawers to be moved away from the space surrounded by said front frame unit, said back frame unit, and said storage box.

2. The combination tool case as claimed in claim 1, wherein said front frame unit further comprises fastening means respectively provided at the beveled coupling faces of said open frame and the beveled coupling faces of said side panels and adapted for securing said open frame and said side panels in the second position.

3. The combination tool case as claimed in claim 2, wherein said fastening means of said front frame unit comprises a plurality of plug rods respectively protruded from the beveled coupling faces of said open frame, and a plurality of plug holes respectively disposed in the beveled coupling faces of said side panels and adapted for receiving the plug rods at the beveled coupling faces of said open frame.

4. The combination tool case as claimed in claim 1, wherein said back frame unit further comprises fastening means provided at the beveled coupling face of said back panel and the beveled coupling face of said bottom panel and adapted for securing said bottom panel and said back panel in the second position.

5. The combination tool case as claimed in claim 4, wherein the fastening means of said back frame unit comprises a plurality of plug rods respectively protruded from the beveled coupling face of said back panel, and a plurality of plug holes respectively disposed in the beveled coupling face of said bottom panel and adapted for receiving the plug rods at the beveled coupling face of said back panel.

6. The combination tool case as claimed in claim 1, wherein said front frame and back frame fastening structure comprises a plurality of plug holes disposed in an inner sidewall of said open frame at a bottom side, and a plurality of plug rods respectively protruded from a front side edge of said bottom panel and adapted for engaging the, plug holes in said open frame.

7. The combination tool case as claimed in claim 6, wherein said front frame and back frame fastening structure further comprises two sliding grooves respectively transversely disposed in inner sidewalls of said side panels, and two sliding rails respectively formed integral with two opposite lateral sides of said bottom panel and adapted for inserting into the sliding grooves in said side panels.

8. The combination tool case as claimed in claim 6, wherein said front frame and back frame fastening structure further comprises a plurality of screws respectively driven into said back panel to fixedly secure said back panel to rear sides of said side panels.

9. The combination tool case as claimed in claim 1, wherein said side panels of said front frame unit each have a transverse rib disposed in same elevation of the topmost edge of said open frame of said front frame unit and the topmost edge of said back panel of said back frame unit and adapted for supporting said box body of said storage box on said open frame of said front frame unit and said back panel of said back frame unit at a top side; a positioning structure is provided at said box body of said storage box and said side panels of front frame unit and adapted for securing said box body to said side panels.

10. The combination tool case as claimed in claim 9, wherein said positioning structure comprises a plurality of recessed plug holes respectively disposed in said side panels, and a plurality of engaging blocks respectively protruded from two opposite lateral sidewalls of said box body and adapted for engaging said recessed plug holes.

11. The combination tool case as claimed in claim 9, wherein said storage box further comprises two snaps provided at the box body and cover of said storage box for locking the box body and cover of said storage box when the cover of said storage box closed on the box body of said storage box.

12. The combination tool case as claimed in claim 11, wherein the cover of said storage box comprises a chamber and a hinged cover plate adapted for closing said chamber.

13. The combination tool case as claimed in claim 12, wherein said storage box further comprises a plurality of partition plates mounted in said chamber and dividing said chamber into multiple compartments.

14. The combination tool case as claimed in claim 1, wherein said drawers are flat box members, each having a plurality of top recesses adapted for keeping tools.

15. The combination tool case as claimed in claim 1, further comprising a drawer partition structure adapted for separating said drawers in the space surrounded by said front frame unit, said back frame unit, and said storage box, said drawer partition structure comprising a plurality of rails symmetrically transversely provided at said side panels, and a plurality of sliding flanges respectively transversely formed integral with said drawers at two opposite lateral sides and respectively supported on the rails at said side panels.

16. The combination tool case as claimed in claim 15, wherein the rails of said drawer partition structure each have two stop blocks protruded from two ends thereof, said sliding flanges each have a stop block at a rear end thereof for movement with said drawers relative to the stop blocks at said side panels to limit the moving distance of said drawers.

17. The combination tool case as claimed in claim 1, wherein said drawer positioning structure further comprises a through hole through said box body of said storage box, and a recessed locating hole in said bottom panel of said back frame unit; said locating rod is a round rod inserted through the through hole in said box body and positioned in the recessed locating hole in said bottom panel of said back frame unit, having two longitudinal planes at two sides and an angled grip extended from a top end thereof.

18. The combination tool case as claimed in claim 17, wherein said drawer positioning structure further comprises a staple fixedly fastened to said back panel of said back frame unit to hold said locating rod in place, for enabling said locating rod to be rotated in the through hole in said box body and the recessed locating hole in said bottom panel of said back frame unit.

19. The combination tool case as claimed in claim 17, wherein said clamping plates of said drawer positioning structure each have a circular hole and a mouth in communication with said circular hole.

20. The combination tool case as claimed in claim 17, wherein said drawer positioning structure further comprises a plurality of marks made on said box body around the through hole of said drawer positioning structure for indication of the direction of rotation of said locating rod between the first position and the second position.

* * * * *